US006186810B1

(12) United States Patent
Barnabe et al.

(10) Patent No.: US 6,186,810 B1
(45) Date of Patent: Feb. 13, 2001

(54) FEMALE ELECTRICAL CONTACT MEMBER

(75) Inventors: Stéphane Barnabe, Chaville; Fabrice Durand-Cochet, Rambouillet, both of (FR)

(73) Assignee: Connecteurs Cinch, Le Bretonneux (FR)

( * ) Notice: Under 35 U.S.C. 154(b), the term of this patent shall be extended for 0 days.

(21) Appl. No.: 09/378,375

(22) Filed: Aug. 20, 1999

(30) Foreign Application Priority Data

Sep. 8, 1998 (FR) ..... 98 11207

(51) Int. Cl.[7] ..... H01R 13/64
(52) U.S. Cl. ..... 439/252
(58) Field of Search ..... 439/252, 246, 439/843, 851, 162, 32, 33

(56) References Cited

U.S. PATENT DOCUMENTS 5,951,314 * 9/1999 Durand-Cochet et al. ..... 439/252

FOREIGN PATENT DOCUMENTS 678 936 10/1995 (EP) .
97 00109 7/1998 (FR) .
2 231 454 11/1990 (GB) .

* cited by examiner

*Primary Examiner*—Paula Bradley
*Assistant Examiner*—Antoine Ngandjui
(74) *Attorney, Agent, or Firm*—Pearne & Gordon LLP

(57) ABSTRACT

A female electrical contact member has a body extended by a bush open at its free end for insertion of a male member and a male-member-receiving member comprises a ring extended by elastic tongues which grip the male member. The ring is mounted to slide and float in the bush and is connected to the body by a flexible electrical connection. Sliding of the ring in the bush is restricted. The flexible electrical connection forms a loop at a point part way along its length.

2 Claims, 3 Drawing Sheets

FEMALE ELECTRICAL CONTACT MEMBER

BACKGROUND OF THE INVENTION

1. Field of the Invention

The present invention relates to a female electrical contact member.

2. Description of the Prior Art

The invention relates to a female electrical contact member comprising a body with means at one end for fixing an electrical conductor and a member at the other end for receiving a complementary male electrical contact member, wherein the body is extended by a bush open at its free end for insertion of the male member, the male-member-receiving member comprises a ring extended toward the electrical conductor fixing means by elastic tongues adapted to grip the male member, the ring is mounted to slide and float in the bush and is connected to the body by a flexible electrical connection, and means are provided to restrict sliding of the ring in the bush.

Because of this arrangement, the body of the female electrical contact member can be subject to vibrations, which are weakly transmitted to the ring; however, the ring vibrates without moving relative to the male member, which prevents corrosion between the contact members.

For the ring to be able to move freely inside the bush, a braid is used as the electrical connection and the part between the ring and the end of the body provided with the electrical conductor fixing means forms undulations.

An arrangement of the above kind is entirely satisfactory from the point of view of its operation but it has been found that fabrication is difficult and that the small radii with which the flexible braid is bent leads to relatively high stiffness in the parts joined to the body and to the ring.

One aim of the invention is to remedy this drawback.

SUMMARY OF THE INVENTION

In accordance with the invention, a female electrical contact member comprises a body with means at one end for fixing an electrical conductor and a member at the other end for receiving a complementary male electrical contact member, wherein the body is extended by a bush open at its free end for insertion of the male member, the male-member-receiving member comprises a ring extended toward the electrical conductor fixing means by elastic tongues adapted to grip the male member, the ring is mounted to slide and float in the bush and is connected to the body by a flexible electrical connection, means are provided to restrict sliding of the ring in the bush, and the flexible electrical connection is bent at a point part way along its length to form a loop.

With an arrangement of the above kind, the electrical connection is more flexible and the mechanical stresses in the connecting parts are reduced, the radius of bending the electrical connection being increased.

The flexible electrical connection is preferably a metal braid.

The flexible electrical connection is partially covered with a sheath to protect the flexible electrical connection when inserting the male member and to prevent wear of the male member caused by the vibrations.

The sheath is preferably made of tetrafluoroethylene.

In accordance with one constructional detail, the bush is attached to the body, which has at the end opposite that provided with the means for fixing it to an electrical conductor a rectangular section portion into the bottom of which is cut and bent a bearing surface for the electrical conductor fixed to the ring, and lugs are cut into the rectangular section portion and bent toward the corresponding end of the flexible electrical connection to crimp it with the corresponding end of its sheath.

Finally, in accordance with a final feature of the invention, the ring is extended by two strips, one of which terminates in lugs for crimping the corresponding end of the electrical conductor and binding the corresponding end of the sheath, and the strips have an elbow whose convex parts face toward each other to form a contact area complementary to the male member.

The invention will now be described in more detail with reference to a particular embodiment shown by way of example in the accompanying drawings.

DETAILED DESCRIPTION OF THE PREFERRED EMBODIMENT

Figure 1:
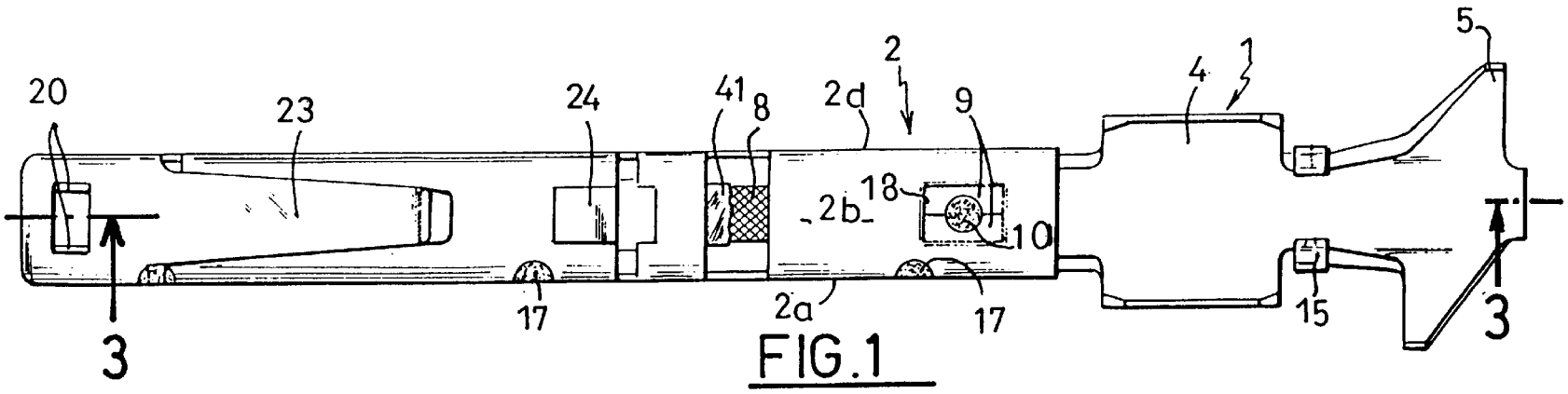
FIG. 1 is a plan view of a female electrical contact member of the invention.
Figure 2:
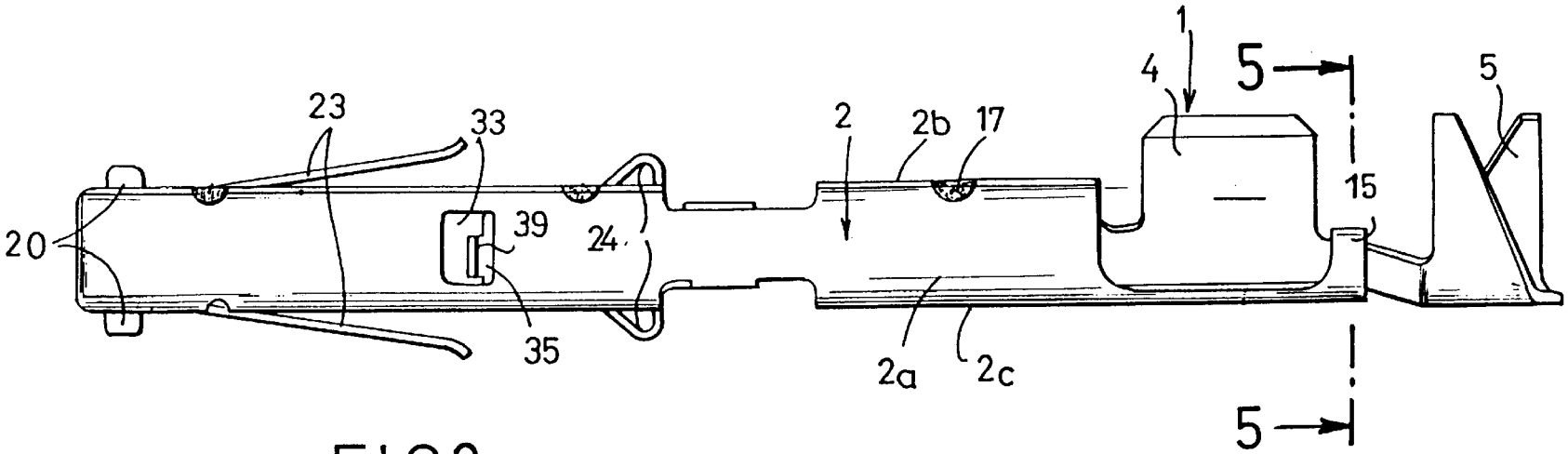
FIG. 2 is a corresponding elevation view.

The female electrical contact member shown in the drawings is in four parts, namely a body 1, a bush 2, a member in the form of a ring 3 for receiving a male member, and a flexible electrical connection 8.

The body 1 includes crimping lugs 4 and 5.

At the end opposite the crimping lugs 4 and 5, the body 1 is extended by a rectangular section part 6 with a bottom 6*a*, two lateral walls 6*b* and two rings 6*c*. A cut-out in the bottom 6*a* defines a bearing surface 7 for a braid 8. Two lugs 9 cut out from the lateral walls 6*b* and the rim 6*c* fix the flexible braids 8 to the bearing surface 7, a spot weld 10 being effected at the junction of the lugs 9.

Cutting out the lugs 9 forms an opening 11 in the rims 6*c*.

The bush 2 is made from a metal having better mechanical properties than that of the part 1 and has at one end a bar 14 terminating at two lugs 15 which are bent over the body 1 in the gap between the crimping lugs 4 and 5.

At the end opposite the bar 14 the bush 2 is bent to form a rectangular section with four sides 2*a*, 2*b*, 2*c* and 2*d*, the longitudinal edge of the side 2*b* coinciding with the longitudinal edge of the side 2*a*, these two edges being joined by spot welds 17.

The portion of the bush 2 in line with the lugs 9 has a depressed portion 18 producing inwardly bent lugs 18*a* which cooperate with the opening 11 formed by cutting out the lugs 9.

A second depressed portion 19 on the face 2*c* of this same portion of the bush 2 has edges that coincide with the opening cut in the part 6 to form the bearing surface 7. The bush 2 is therefore anchored to the part 1.

Two ears 20 are cut into the faces 2*b* and 2*c* of the bush 2, at its free end, in which there is an opening 22 for a complementary rectangular section male member to pass through.

Two retaining tongues 23 for immobilizing the female electrical contact member in a passage of a connector and two bent portions 24 which constitute shoulders for cooperating with a locking key, for example, are cut into the sides 2*b* and 2*c*, the ears 20 forming polarizer means so that said member can be fitted only one way round.

The ring 3 has a substantially rectangular section with an opening 25 at one end corresponding to the opening 22 for receiving the male member. Two opposite sides 3*a* and 3*b* of the ring 3 are cut and bent to form a kind of elastic clamp with elastic contact tongues 27 and the opposite two sides 3*c* and 3*d* are extended by respective strips 29 and 30, said strip 29 terminating in two lugs 31 for crimping the corresponding end of the braid 8. The two strips 29 have elbows 28 near the elastic contact tongues 27 with their convex surfaces facing each other to form complementary contact areas.

Respective holes 33 and 34 are formed in the walls 2*d* and 2*a* of the bush 2, the edge of each hole 33, 34 forming a boss which constitutes a respective abutment 35, 36.

In the vicinity of the lugs 31 the strips 29 and 30 are joined by two plates 38 each of which has a bent portion 39, one of which engages in the hole 33 and the other one in the hole 34. The ring 3 is therefore mounted to move freely within the bush 2 between its free end and the abutments 35, 36.

When the male member is inserted, it abuts against the elastic blades 27 and the elbows 28 of the strips 29 and 30 and tends to push on the ring 3, sliding of which is restricted by the abutments 35 and 36 so that the male member can be inserted completely into the ring 3.

The flexible braid 8 is covered over all of its length, except at the ends, with a protective sheath 40 made of tetrafluoroethylene, for example, the ends of the sheath being gripped between the lugs 9, on the one hand, and between the lugs 31, on the other hand.

Figure 3:
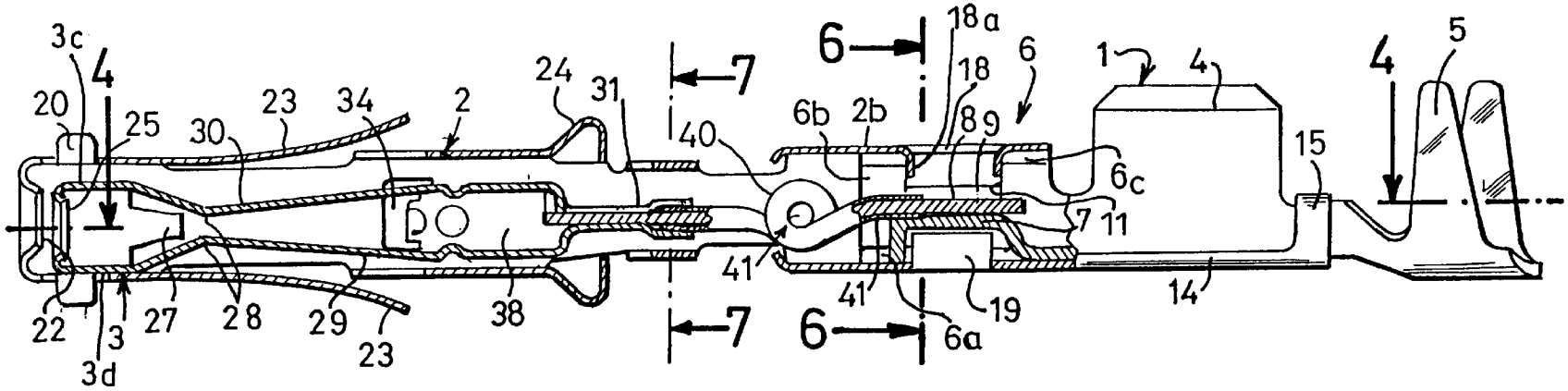
FIG. 3 is a view in section taken along the line 3—3 in FIG. 1.
Figure 4:
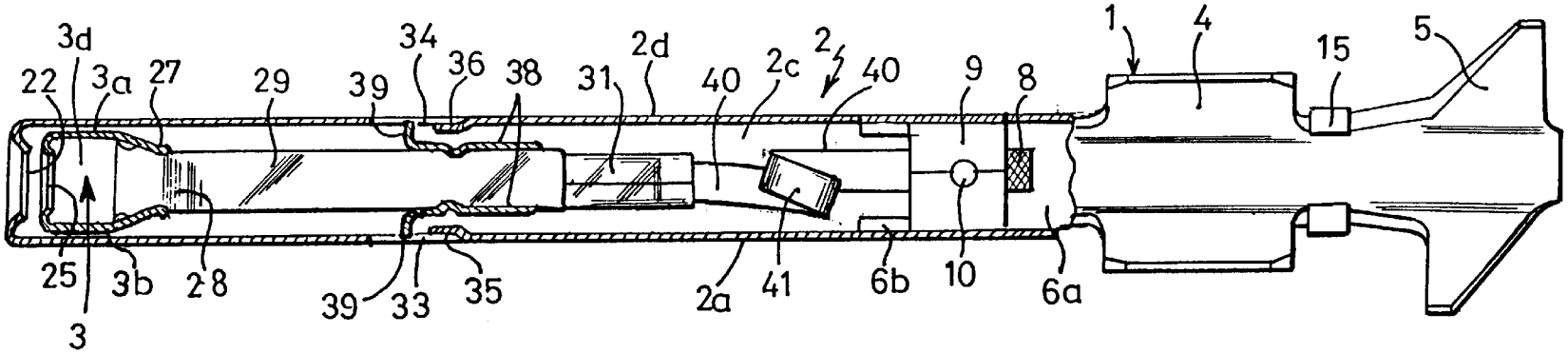
FIG. 4 is a view in section taken along the line 4—4 in FIG. 3.
Figure 5:
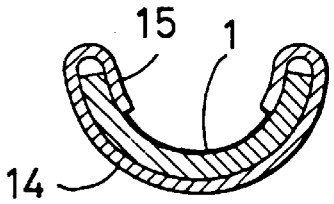
FIG. 5 is a view in section taken along the line 5—5 in FIG. 2.
Figure 6:
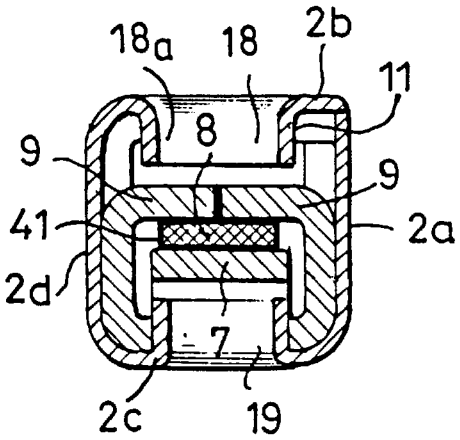
FIG. 6 is a view in section taken along the line 6—6 in FIG. 3.
Figure 7:
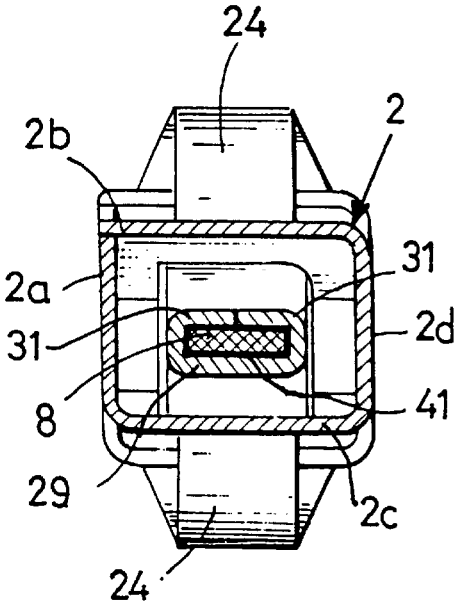
FIG. 7 is a view in section taken along the line 7—7 in FIG. 3.

As can be seen in FIGS. 3 and 4, the flexible braid 8 covered with its sheath 40 forms a loop 41 at a point part way along its length.

Because of this arrangement, fabrication is simplified and all of the portion of the flexible braid 8 forming the loop 41 is protected by the sheath 40.

The shape of the flexible braid 8 allows relative movement of the ring 3 and the sheath 40, increases the mechanical strength of the flexible braid 8 and prevents rubbing in the area of the loop wearing the braid.

When the male member is inserted, it remains attached to the ring 3, without vibrations causing any relative movement of the ring 3 relative to the male member.

Of course, the invention is not limited to the embodiment shown that has just been described, to which many modifications of detail can be made without departing from the scope of the invention.

There is claimed:

1. A female electrical contact member comprising a body with means at one end for fixing an electrical conductor and a male-member-receiving member at another other end for receiving a complementary male electrical contact member, wherein said body is extended by a bush open at its free end for insertion of said male member, said male-member-receiving member comprises a ring extended toward said electrical conductor by elastic tongues adapted to grip said male member, said ring is mounted to slide and float in said bush and is connected to said body by a flexible metal braid, means are provided to restrict sliding of said ring in said bush, and said flexible metal braid is bent at a point, part away along its length form at least one complete loop covered by a sheath.

2. The female electrical contact member claimed in claim 1 wherein said sheath is made of tetrafluoroethylene.

* * * * *